US005813945A

United States Patent [19]

Bernacki

[11] Patent Number: 5,813,945

[45] Date of Patent: Sep. 29, 1998

[54] SWIM INSTRUCTION, TRAINING, AND ASSESSMENT APPARATUS

[76] Inventor: Robert H. Bernacki, P.O. Box 3188, Bloomington, Ind. 47402-3188

[21] Appl. No.: 708,644

[22] Filed: Sep. 5, 1996

[51] Int. Cl.[6] ..... A63B 31/00

[52] U.S. Cl. ..... 482/5; 482/6; 482/55; 482/56; 434/247; 434/254

[58] Field of Search ..... 434/247, 254; 482/1–9, 51, 55, 56, 63, 92, 901, 903; 4/904; 441/55

[56] References Cited

U.S. PATENT DOCUMENTS

| | | |
|---|---|---|
| 2,825,224 | 3/1958 | Lindenauer . |
| 3,517,930 | 6/1970 | Jacobsen . |
| 3,731,921 | 5/1973 | Andrews . |
| 3,848,467 | 11/1974 | Flavell . |
| 3,861,675 | 1/1975 | Hopper . |
| 3,988,020 | 10/1976 | Carter . |
| 4,082,267 | 4/1978 | Flavell . |
| 4,114,874 | 9/1978 | Mattila . |
| 4,184,678 | 1/1980 | Flavell . |
| 4,302,007 | 11/1981 | Oprean . |
| 4,524,711 | 6/1985 | Ashrow . |

(List continued on next page.)

FOREIGN PATENT DOCUMENTS

| | | |
|---|---|---|
| 2596663 | 10/1987 | France . |
| 237325 | 5/1994 | New Zealand . |
| 624646 | 9/1978 | U.S.S.R. . |
| 842926 | 5/1981 | U.S.S.R. . |
| 874080 | 10/1981 | U.S.S.R. . |
| 943810 | 7/1982 | U.S.S.R. . |
| 1192840 | 11/1985 | U.S.S.R. . |
| 1222292 | 4/1986 | U.S.S.R. . |
| 1535554 | 1/1990 | U.S.S.R. . |
| 2094647 | 9/1982 | United Kingdom . |
| 2102683 | 2/1983 | United Kingdom . |
| WO81/01507 | 6/1981 | WIPO . |
| WO86/00024 | 1/1986 | WIPO . |

OTHER PUBLICATIONS

B. Bingham, Electromyography, "Swimming Technique," (1993), vol.29, No.4, pp. 12–14.

C. Colwin, Swimming into the 21st Century. (1991) Leisure Press, Champaign, IL.

D. Costill, "Computer Based System for the Measurement of Force and Power During Front Crawl Swimming.", (1986) J. Swimming Res. V2., No. 1 pp. 16–19.

D. Costill, E. Maglischo, and A. Richardson, "Handbook of Sports Medicine and Science: Swimming.", (1992). Blackwell Scientific Publications, Oxford, England.

(List continued on next page.)

*Primary Examiner*—Glenn E. Richman

[57] ABSTRACT

An instructional, training, and assessment apparatus is provided for use in the activity of swimming. The apparatus includes a cable having a proximal end and a distal end, and a harness for coupling the distal end of the cable to a swimmer. A motorized drum mechanism is coupled to the proximal end of the cable for winding and unwinding the cable to apply forces to the swimmer as the swimmer swims laps in a pool. A pressure roller applies pressure to the cable as it is wound and unwound in multiple layers upon the drum. A bailer sheave and idler roller engaged with the sheave and mounted on shafts transverse to the drum guide the cable in even rows onto the drum. A cable diameter limit sensor coupled to the above described bailer sheave and the motorized drum senses the increased diameter of the distal end of the cable whereupon the motorized drum halts the winding action in response to the limit sensor signal. Cable speed and force sensors are provided for generating output signals responsive to the speed of and force exerted on the cable. The apparatus also includes a controller responsive to the output signal from the force sensor and the speed sensor and to an external speed parameter represented by a reference signal for controlling the forces applied by the winding and unwinding mechanism. The controller of the apparatus further includes a signal averaging means coupled to the speed sensor signal and to the controller limiting the rate of change of positive forces to the swimmer while the swimmer is swimming in response to changes in the swimmer's speed.

14 Claims, 8 Drawing Sheets

U.S. PATENT DOCUMENTS

| | | |
|---|---|---|
| 4,529,192 | 7/1985 | Stites . |
| 4,654,010 | 3/1987 | Havriluk . |
| 4,681,118 | 7/1987 | Asai . |
| 4,778,175 | 10/1988 | Wucherpfennig . |
| 4,804,326 | 2/1989 | Lennon . |
| 4,869,497 | 9/1989 | Stewart . |
| 4,907,795 | 3/1990 | Shaw . |
| 4,910,447 | 3/1990 | Masters . |
| 4,930,770 | 6/1990 | Baker . |
| 4,934,694 | 6/1990 | McIntosh . |
| 4,998,725 | 3/1991 | Watterson . |
| 5,002,268 | 3/1991 | Anderson . |
| 5,011,137 | 4/1991 | Murphy . |
| 5,391,080 | 2/1995 | Bernacki . |

OTHER PUBLICATIONS

J. Counsilman, "Competitive Swimming Manual for Coaches and Swimmers.", (1977) Counsilman Co. Inc. Bloomington IN.

J. Counsilman, "The Science of Swimming.", (1968) Prentice–Hall, Inc. Englewood Cliffs, NJ.

A. Craig Jr. et al, "Velocity, stroke rate, and distance per stroke during elite swimming competition.", (1985) Medicine and Science in Sports and exercise vol. 17. No. 6, pp. 625–634.

Y. Dote, "Servo Motors and Motion Control Using Digital Signal Processors.", (1990) Prentice–Hall, Englewood, NJ. pp. 17–20, 23–27, 62–69, 109, 112, 113.

R. Fry et al, "Overtraining in Athletes.", (1991) Sports Medicine vol. 12, No. 1, pp. 32–65.

P. Klentrou et al, "Physiologic and Physical Correlates of Swimming Performance.", (1991) vol. 7, No. 1, pp. 13–18.

C. Kelly, "Stanford Towing", (1993) Swimming World, V34 No. 4, pp. 13–18.

E. Maglischo, "Swimming even faster." (1993) Mayfield Publishing. Mountain View, CA, pp. 100–107.

Mestre, Bladimiro, "New Teaching Aids to Measure Stroke Efficiency.", (1992) Swim Canada, Jan., p. 9.

L. Rabiner and B. Gold, "Theory and Application of Digital Signal Processing.", (1975) Prentice–Hall. pp. 40–43, 88–90, 219–224.

B. Ria et al, "Assessment of the Mechanical Power in the Young Swimmer.", (1990) J. Swimming Res. V6, No. 3, pp. 11–15.

A. Roberts, "Effectiveness of Biokinetic Training on Swimming Performance in Collegiate Swimmers.", (1991) J. Swimming Res. V7, No.3, pp. 5–11.

D. Rohrs et al, "Evaluation of Anaerobic Power and Capacity in Competitive Swimmers.", (1991) J. Swimming Research. vol.7, No.3, pp. 12–16.

R. Sharp et al, "Relationship between power and sprint freestyle swimming.", (1982) Medicine and Science in Sports and Exercise. vol. 14, No. 1, pp. 53–56.

H. Toussaint et al, "Propelling Efficiency of Front–crawl swimming.", (1988) J. of Appl. Physiol. vol. 65., No. 6, pp. 2506–2512.

Buckley Power & Stroke Benches, Brookline, NH, brochure. Jan. 1993.

Fitness Systems Inc., Independence MO. brochure. Sep. 1989.

Mestre Enr., Ste–Foy, Quebec Canada. "Research and Development, Swimming". Sales pamphlet. May 1991.

Total Performance Inc., Mansfield, OH. "Power Rack" brochure. 1991.

VASA, Williston, VT, "Swim Trainer" brochure. 1991.

Michel Seelles, National Swimming Training Center Paris, France, "C.A.T.S." brochure, 1994.

Sparta Ltd., Napier, NZ, "Speed Trainer" brochure, 1994.

Total Performance Inc., Mansfield, OH, "Speed Assist" ad, 1995.

Total Performance Inc. Mansfield, OH. "Power Reel" advertisement, 1996.

R. Madrigal, "Sprint–Assisted Towing", (Nov. 1983) Swimming Technique, pp. 33–36.

D. Costill, "Video–Computer Assisted Analysis of Swimming Technique", J. of Swimming Res. vol. 3, No. 2 (1987) pp. 5–9.

SWIM INSTRUCTION, TRAINING, AND ASSESSMENT APPARATUS

FIELD OF THE INVENTION

The present invention relates to instructional, training, assessment, and research devices for the activity of swimming and, in particular, to the control and monitoring of the application of positive and negative forces to the swimmer, via electrodynamic means under electronic controller means, as are necessary for the implementation of protocols associated with the aforementioned aspects of swimming.

BACKGROUND OF THE INVENTION

One of the key concepts of athletic training is specificity of training. The training activity most appropriate to achieving optimal swimming performance is that of swimming at competition or maximal speeds. Since that level of performance can only be maintained for very short periods of time, external assistance is required for extended training periods. The goals of training for competition speeds include those of increasing stroke rate to competition tempo and "imprint" that tempo, to increase stroke length at competition speeds, to increase the propulsive power component of the stroke, to reduce recovery time, to improve stroke balance, and to reduce dynamic drag.

Recently, a sophisticated apparatus for swim instruction, training, and assessment permitted the implementation of these coaching principles in practice (see my U.S. Pat. No. 5,391,080). However, improvements in economy and mechanical complexity appeared necessary in order to provide access to this technology for the greatest number of swimmers and coaches

SUMMARY OF THE INVENTION

In the present invention, economical and simplified apparatus are revealed for the application of forces to a swimmer while swimming for the implementation of various instructional, training, and assessment methodologies. Economies are obtained through a reduction in the complexity of mechanics and electronics over prior art. In addition, the present invention provides for the storage and plotting of a swimmer's speed, stroke patterns, assisting force and resisted excess force for use in stroke mechanics analysis. Improved assessment features include controlled cable force during assessment for the prevention of cable slack during the measurement and plotting of a swimmer's speed while swimming.

In accordance with the present invention, positive force applying means are revealed for pacing a swimmer and off-loading the propulsive force required of the swimmer at or above competition speed while minimizing detrimental effects on the swimmer's stroke dynamics. The primary object of reducing force requirements is to permit improved stroke mechanics at an elevated speed for extended periods of time. This improvement in stroke mechanics is typically characterized by an increase in the swimmer's stroke rate and length without a loss of proper form. The present invention therefore does not simply control the speed of the swimmer but rather applies a positive force based on an average pace of the swimmer in relation to a speed setting on a programmable controller. When the swimmer tends to slow below the speed setting, the force is increased, and when the swimmer speeds up above the speed setting, the force is decreased. This varying positive force provides kinesthetic feedback to the swimmer and sets the pace. This process is an approximation and the swimmers speed is measured and averaged over a period approximately equal to the swimmer's stroke period. In addition to the functions described above, the present invention incorporates a speed boost at the start of a lap to maintain cable tension during the swimmer's pushoff from a pool wall.

In accordance with the present invention, additional means are revealed for application of negative or resistance forces to a swimmer, the intensity of which is controlled by a force setting or by a speed limiting setting. The negative force is approximately constant throughout the stroke and is generally independent of the swimmer's speed. In accordance with the present invention, additional means are revealed for data and operational information transmission from the apparatus and an external portable personal computer through a data communications link. Such data, including speed and force measurements may be subsequently or simultaneously plotted on a visual display or stored for later analysis.

The contemplated embodiment of the present invention is comprised of mechanical means which includes a harness coupled to cable means, which passes through a bailer sheave, coupled to a cable diameter sensor and a drum pressure roller, and further coupled to a cable drum and revolution sensor. Said cable drum is coupled to an electric motor which in turn is coupled to a power controller. Said power controller includes a battery power source, coupled to a power regulator which is coupled to a power relay, coupled to a run button and coupled to a programmable logic and numeric processing means. Said programmable logic and numeric processing means is coupled to data storage means, push button data entry switches, an alphanumeric data visual display, visual warning light, and a data communication interface means for coupling to an external general purpose computer. Said power controller includes analog sensor amplifiers coupled to signal filter means.

Additional objects, features, and advantages of the present invention will become apparent to those skilled in the art upon consideration of the following illustration of the contemplated embodiment presented in the detailed description and accompanying drawings.

BRIEF DESCRIPTION OF THE DRAWINGS

The detailed description of the contemplated embodiment makes reference to the accompanying figures in which.

DETAILED DESCRIPTION OF THE PRESENT INVENTION

Referring now more particularly to the figures, enumerated as numbers 1 through 8, the following detailed description of mechanical drawings, block diagrams, and schematics, shall serve to illuminate various particulars of an illustrative embodiment of the disclosures and teachings of the present invention. Throughout the following description are several references to specific mechanical and electrical components which serve to clarify various aspects of the invention. It will be understood that these specific component references are not limitations and that the teachings and disclosures of the present invention may be practiced with alternative components. In other instances, structures and methods well known to those skilled in the art or which have been revealed in detail in my previous U.S. Pat. No. 5,391,080 have been omitted or have not been described in detail in order to avoid unnecessary complexity which would tend to obscure the teachings and disclosures of the present invention. In particular, programs, flowcharts, and machine code are not presented herein as the relevant information has been revealed in extensive control flowcharts taught in my above mentioned patent.

Figure 1:
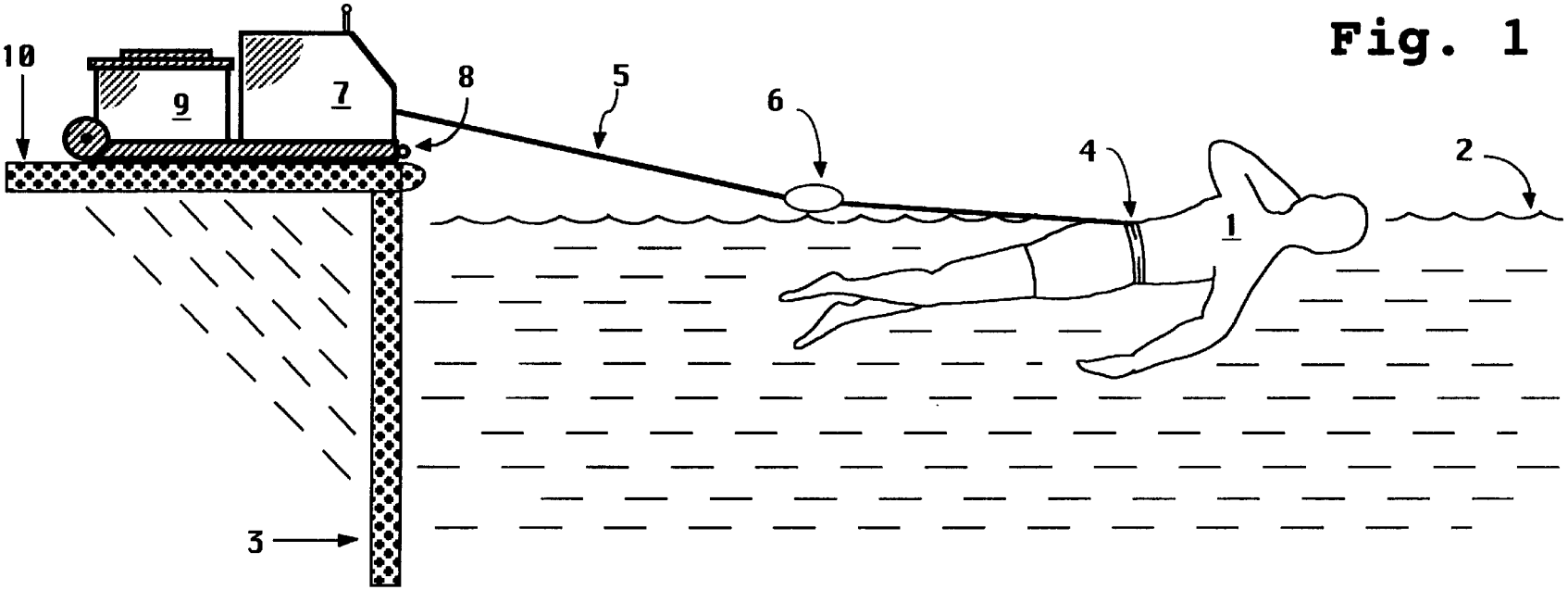
FIG. 1 depicts the apparatus mounted at poolside and attached to a swimmer via a line and harness assembly.

Referring now to FIG. 1, a swimmer herein referred to by the numeral 1 is depicted on a surface 2 of a body of water in a pool or other containment 3 and is attached at the waist via a belt of other harness 4 to a plastic coated stainless steel aircraft cable 5. A float 6 is attached to the cable 5 just before the swimmer 1. Subsequently, the cable 5 is directed upwards from the water surface 2 to a drive train assembly 7 mounted with a battery housing 9 on a base 8 which is depicted resting on a deck surface 10 of the pool 3.

Figure 2:
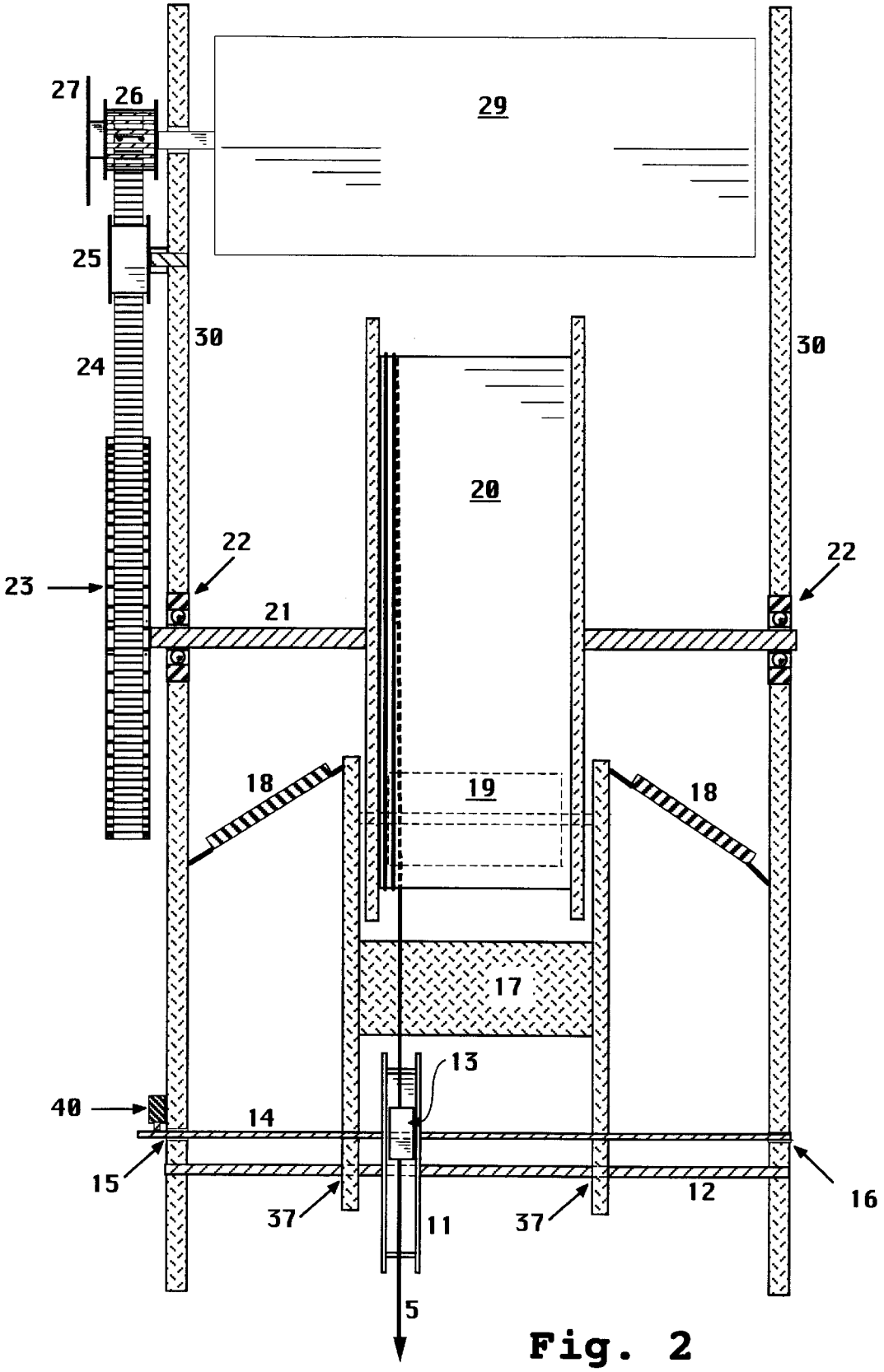
FIG. 2 depicts the top view of one embodiment of the present invention illustrating several of the principle features of the mechanical drive train including the drum, the bailer, the motor, and the drive train.

Referring now to FIG. 2, the cable 5 is guided by a bailer sheave 11 mounted on a stainless steel shaft 12 and an idler roller 13 mounted on a stainless steel shaft 14, the cable 5 being directed towards the top of a pressure roller 19 and subsequently onto a flanged drum 20 mounted on a stainless steel shaft 21. A pressure roller arm assembly 17 is coupled to the pressure roller 19 and contains shaft bores 37 through which passes the sheave shaft 12. The roller shaft 14 is mounted in the drive train 7 frame assembly 30. All of the above components of FIG. 2, except for the shafts 12, 14, and 21, should be fabricated from PVC, DELRIN, Teflon, or other similar materials. The idler roller shaft 14 passes through a hole 16 on the right side of the frame assembly 30 and through a slot 15 in the left side of the frame assembly 30 and subsequently contacting limit switch 40. The limit switch 40 must have a rating equal to, or exceeding an IP67 rating. Tension springs 18 attached from pressure roller arm assembly 17 to frame assembly 30 cause pressure roller 19 to apply pressure to the cable 5 forcing the cable 5 against the drum 20. The drum shaft 21 rotates in drum bearings 22 and is coupled to a timing pulley gear 23 which in turn is coupled to a timing pinion 26 via a timing belt 24 which is tensioned by an idler pulley 25. The timing pinion 26 is coupled to a motor 29 and to an optical rotational encoder disk 27. Although an electric motor is employed as a motive power source, alternative motive power sources include hydraulic or pneumatic motors.

Figure 3:
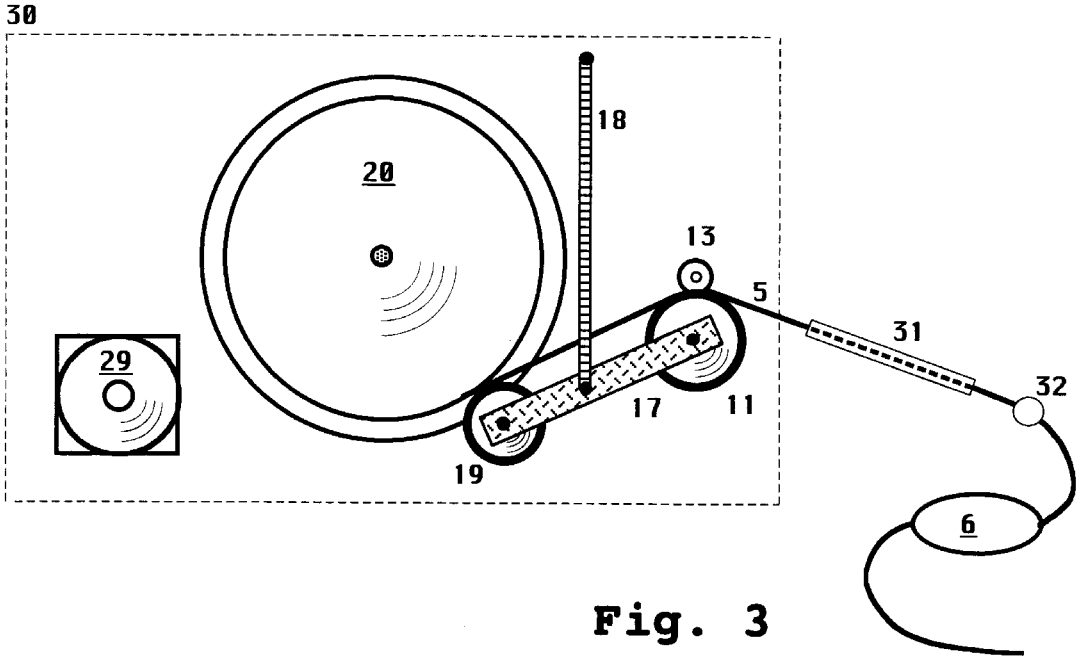
FIG. 3 is a cross-section view of the internal components of the mechanical drive train depicted in FIG. 2.

Referring now to FIG. 3, which depicts a cross-section view of the internal components of the mechanical drive train of FIG. 2, the drum 20 contacts the pressure roller 19 which is mounted on pressure roller arm assembly 17 to which a positive tensioning force, with respect to the drum 20, is applied by tension springs 18 which are coupled from pressure roller arm assembly 17 to frame assembly 30. The cable 5 is guided away from the drum 20 by the pressure roller 19 towards the bailer sheave 11 upon which rides the idler roller 13 which causes the cable 5 to remain in contact with the bailer sheave 11. The cable 5 passes through a plastic jacket 31, is then coupled to a stop sphere 32, is further coupled to the float 6 and subsequently to the harness 4 at the swimmer's 1 waist. The stop sphere 32 should be of a PVC or polypropylene type of plastic.

Figure 4:
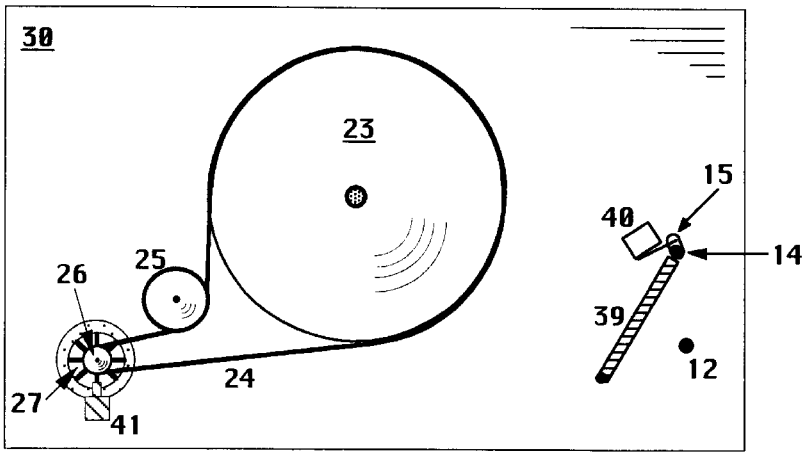
FIG. 4 is a side view of the external components of the mechanical drive train depicted in FIG. 2.

Referring now to FIG. 4, which depicts a side view of the external components of the mechanical drive train depicted in FIG. 2, the timing pulley gear 23 is coupled to a timing pinion 26 via a timing belt 24 which is tensioned by an idler pulley 25 which in turn is mounted to frame assembly 30. The timing pinion 26 is also coupled to an optical rotational encoder disk 27 which is optically coupled to optical encoder sensor 41. The idler roller shaft 14 passes through the slot 15 in the left side of the frame assembly 30 and subsequently contacts the limit switch 40. The idler roller shaft 14 receives a positive force away from the limit switch 40 from a tension spring 39 whose upper end is coupled to the idler roller shaft 14 and whose lower end is coupled to the frame assembly 30. Below the idler roller shaft hole 15 is the end of the bailer sheave shaft 12 which is mounted in the frame assembly 30.

Figure 5:
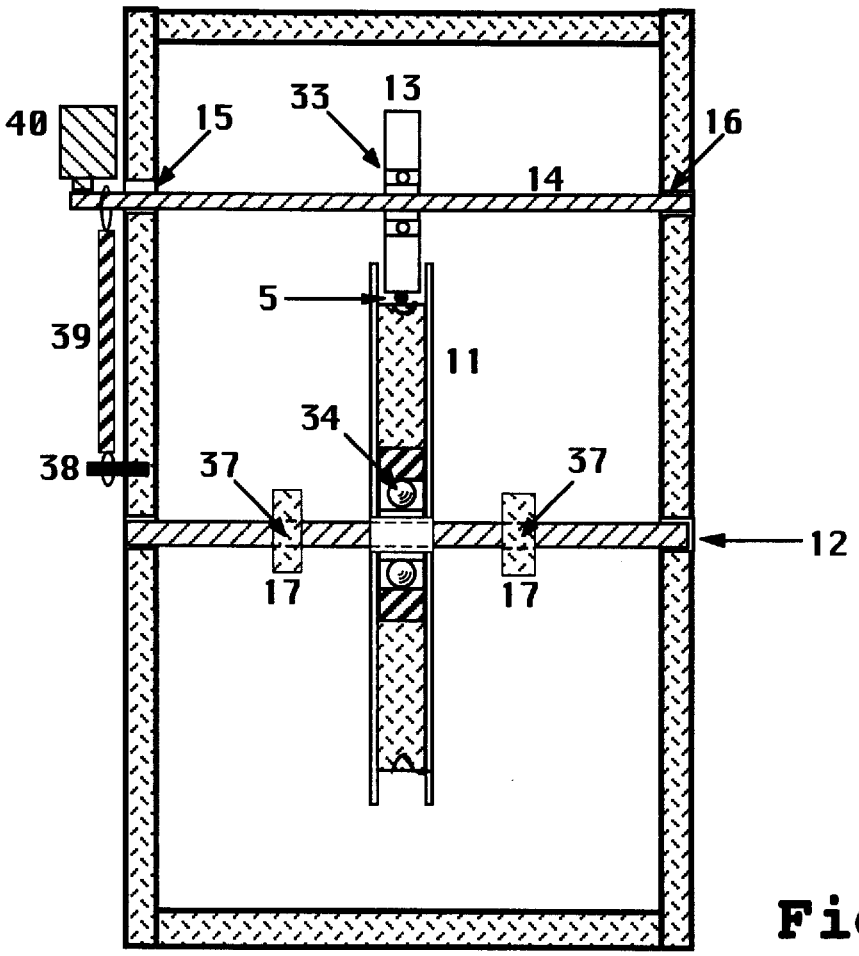
FIG. 5 is a front view of the mechanical drive train depicted in FIG. 2 illustrating the cable, full limit sensor and bailer sheave.

Referring now to FIG. 5, which depicts a front view of the mechanical drive train depicted in FIG. 2. The idler roller shaft 14 is fitted loosely in the hole 16 in the right side of the frame assembly 30. The idler roller shaft 14 passes through the slot 15 in the left side of the frame assembly 30 and subsequently contacts the limit switch 40. The idler roller shaft 14 receives a negative force away from the limit switch 40 from the tension spring 39 whose upper end is coupled to the idler roller shaft 14 and whose lower end is coupled to the frame assembly 30 with a mounting pin 38. Below the idler roller shaft 14 slot 15 is the end of the bailer sheave shaft 12 which is mounted in the frame assembly 30. A pressure roller arm assembly 17 contains shaft bores 37 through which passes the sheave shaft 12 with a shaft to bore clearance similar to that of a sleeve bearing which permits pressure roller arm assembly 17 to rotate freely about sheave shaft 12. The cable 5 is confined between the bailer sheave 11 and the idler roller 13. The idler roller 13 rotates about the idler roller shaft 14 on ball bearing set 33 which is fitted loosely on idler roller shaft 14. The bailer sheave 11 rotates about the bailer sheave shaft 12 on ball bearing set 34 which is fitted loosely on the bailer sheave shaft 12.

Figure 6:
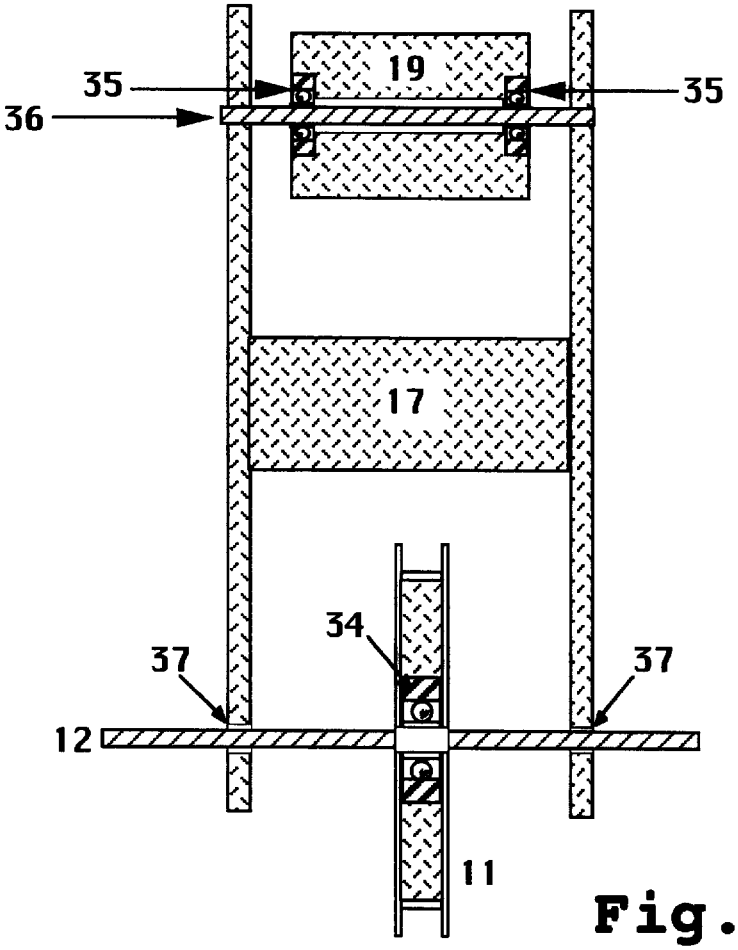
FIG. 6 is a detailed top view of the drum roller and bailer sheave.

Referring now to FIG. 6 which depicts a detailed top view of the pressure roller and bailer sheave, the pressure roller arm assembly 17 is coupled to the pressure roller 19 on a ball bearings 35 which are pressure fitted onto a roller shaft 36 and into the pressure roller 19. The pressure roller arm assembly 17 contains shaft bores 37 through which passes the sheave shaft 12. The bailer sheave 11 rotates about the bailer sheave shaft 12 on ball bearing set 34 which rides on the bailer sheave shaft 12.

Figure 7:
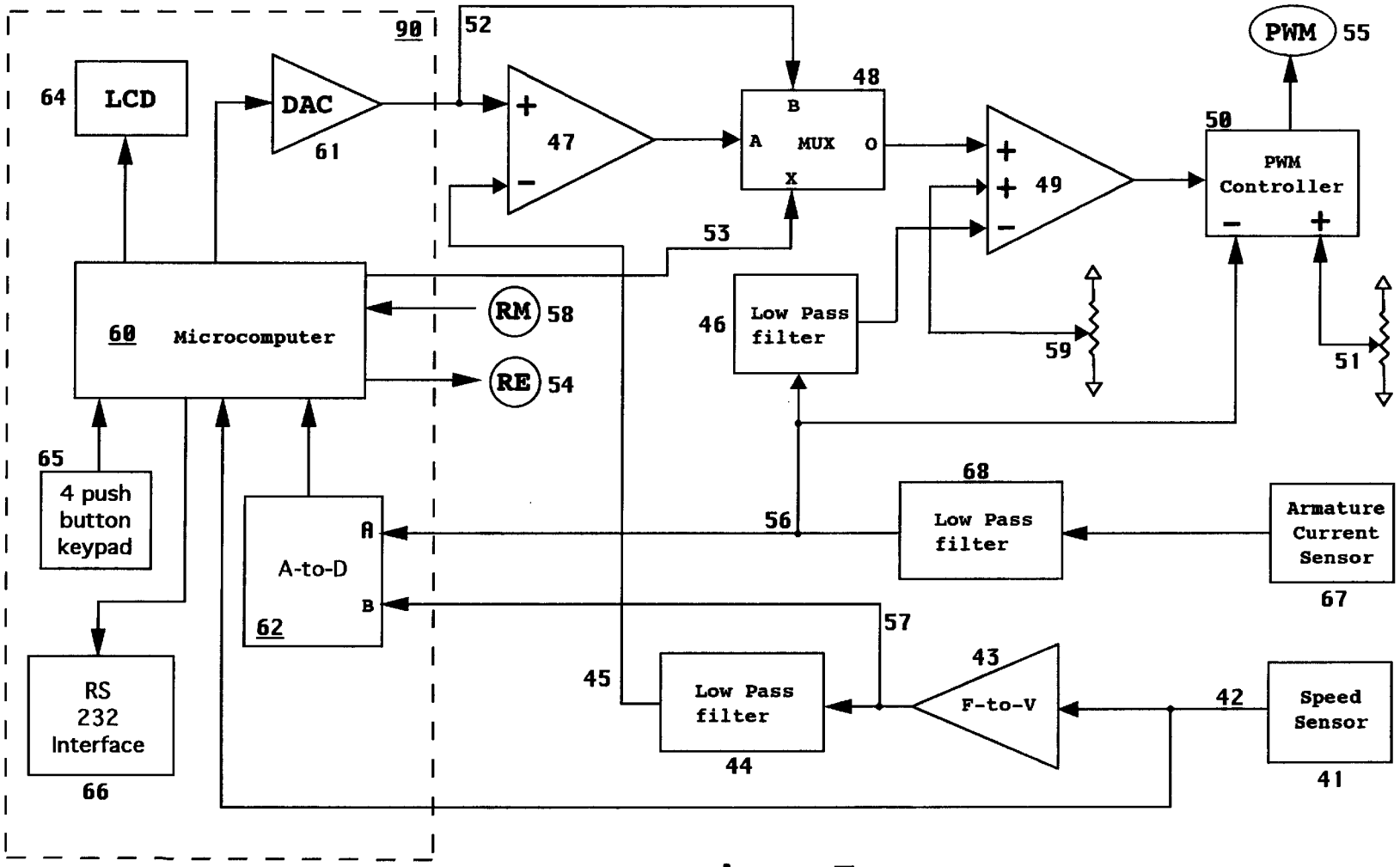
FIG. 7 is a block diagram summary of the electronic control systems in accordance with the disclosures of the present invention.

FIG. 7 depicts a block diagram illustration of an electronic control system which provides for the implementation of the various control functions as described below. Controller 90 is comprised of a single IC microcomputer 60, such as the Motorola 68HC11 series, which is coupled to an Liquid Crystal display (LCD) module 64 having 2 lines of 16 characters, a four button keypad 65, the input of a Digital to Analog (DAC) converter 61, the output of a multiplexed Analog to Digital converter (A2D) 62, and to the input of an RS-232 serial interface 66. A typical DAC for this application would be the MAXIM MAX530 device and the serial interface would be the MAXIM MAX201 device. A typical LCD for this application would be the OPTREX DMC16202NY-LY which includes an LED backlit feature. Various other combinations of microprocessors and support components from other manufacturers might also be utilized, as would be evident to one skilled in the art. The particular choice of processors would depend upon the complexity of the various protocols and measurements one wished to implement on the present invention and their related speed and processing requirements.

The output 52 of the DAC 61 is coupled to a summation input of a first differencing amplifier 47 and to an analog multiplexer 48 B input whose A input is coupled to the output of the first differencing amplifier 47 and whose X control input is coupled to a digital output 53 of the microcomputer 60. The output of the analog multiplexer 48 is coupled to a summation input of a second differencing amplifier 49 whose output is coupled to a Pulse Width Modulation (PWM) controller 50 such as the Texas Instrument TL594 integrated circuit. The PWM output 55 of the PWM controller 50 is coupled to the power control circuit of FIG. 8. An analog offset from resistor divider 59 is summed into the force difference amplifier 49. The microcomputer 60 additionally has an output RE 54 coupled to the power control circuit of FIG. 8 and an input RM 58 coupled to the power control circuit of FIG. 8.

A digital output 42 of the optical encoder sensor 41 is coupled to the microcomputer 60 and to the input of a frequency-to-voltage (F2V) converter 43 such as the National LM2917. The output signal 57 of F2V converter 43 is coupled to the input of a speed signal lowpass filter 44 and to a B input of the A2D converter 62. The output 45 of the speed signal lowpass filter 44 is coupled to an inverting input of the first differencing amplifier 47. An analog output of a motor armature current sensor 67, such as the F. W. Bell BB-100 unit, is coupled to the input of a first current signal lowpass filter 68 whose output 56 is coupled to an A input of the A2D converter 62, to the input of a second current signal lowpass filter 46, and to the inverting input of the PWM controller 50. The output of the second current signal lowpass filter 46 is coupled to the inverting input of the second differencing amplifier 49. A reference signal set by a variable resistor 51 is coupled to the non-inverting input of the PWM controller 50.

Although the illustration of the programmable controller 90 of FIG. 7 employs a microcomputer to implement the various functions of the present invention, there are other various logic implementation such as programmable gate arrays, microprocessors available to one skilled in the art which might be employed to carry out the tasks required. Another embodiment of the present invention might substitute a variable calibrated voltage source for the programmed DAC 61 output 52 combined with coupling control signal RM 58 to control signal 53 and the establishment of a fixed logic level true for signal RE 54.

Figure 8:
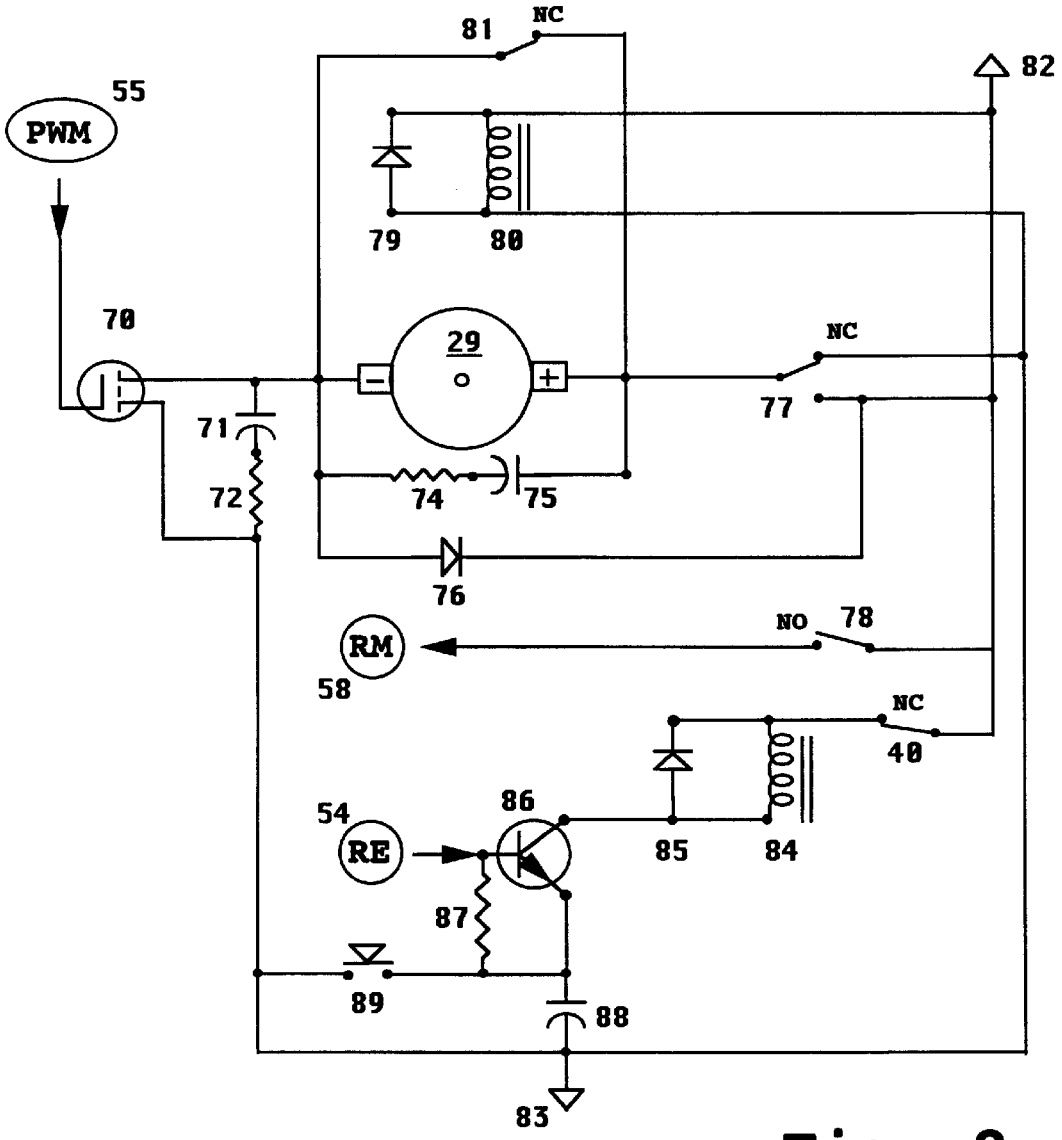
FIG. 8 is a electronic schematic diagram of the motor circuit.

Reference is now to made to the schematic of power control circuit depicted in FIG. 8. An FET transistor 70 whose source is coupled to a battery ground 83, whose gate is controlled by the PWM signal 55. The drain of the FET transistor 70, such as the MOTOROLA MTB75NO5HD HDTMOS power MOSFET, is coupled coupled to a negative terminal of an electric motor 29 and to a snubber capacitor 71 which in turn is coupled to a snubbing resistor 72 which then is coupled to battery ground 83. The electric motor is preferably of the permanent magnet type with skewed armature poles. A positive terminal of the electric motor 29 is coupled through the current sensor 67 and references to the positive terminal shall be assumed to pass through the sensor 67. The negative terminal of the electric motor 29 is coupled to a snubbing resistor 74 which is coupled to a snubber capacitor 75 which is coupled to a positive terminal of the electric motor 29. The negative terminal of the electric motor 29 is also coupled through a normally closed contact set 81 of a relay 80 to the positive terminal of the electric motor 29. A first coil terminal of the relay 80 is coupled to a battery positive 82 and to a cathode of a diode 79, the anode of which is coupled to battery ground 83 and to a second coil terminal of the relay 80. The negative terminal of the electric motor 29 is also coupled to an anode of a diode 76 whose cathode is coupled to battery positive 82. The positive terminal of the electric motor 29 is also coupled to a relay 84 first SPDT contact set 77 common whose normally closed contact is coupled to battery ground 83 and whose normally open contact is coupled to battery positive 82. The signal RM 58 to the controller 90 of FIG. 7 is coupled to a second SPDT contact set 78 common of the relay 84 whose normally open contact is coupled to battery positive 82.

A first terminal of the coil of relay 84 is coupled through a normally closed contact set of the limit switch 40 to battery positive 82. A second terminal of the coil of relay 84 is coupled to a transistor switch 86, such as type 2N2222, collector terminal. The transistor switch 86 emitter terminal is coupled through the normally open contacts of a operator run switch 89 to battery ground 83. The digital control output signal RE 54 from the controller 90 of FIG. 7 connects to the base of transistor switch 86. The base and emitter of the transistor switch 86 are shunted by a resistor 87 and the contacts of the run switch 89 are shunted by a bypass capacitor 88.

Figure 9A:
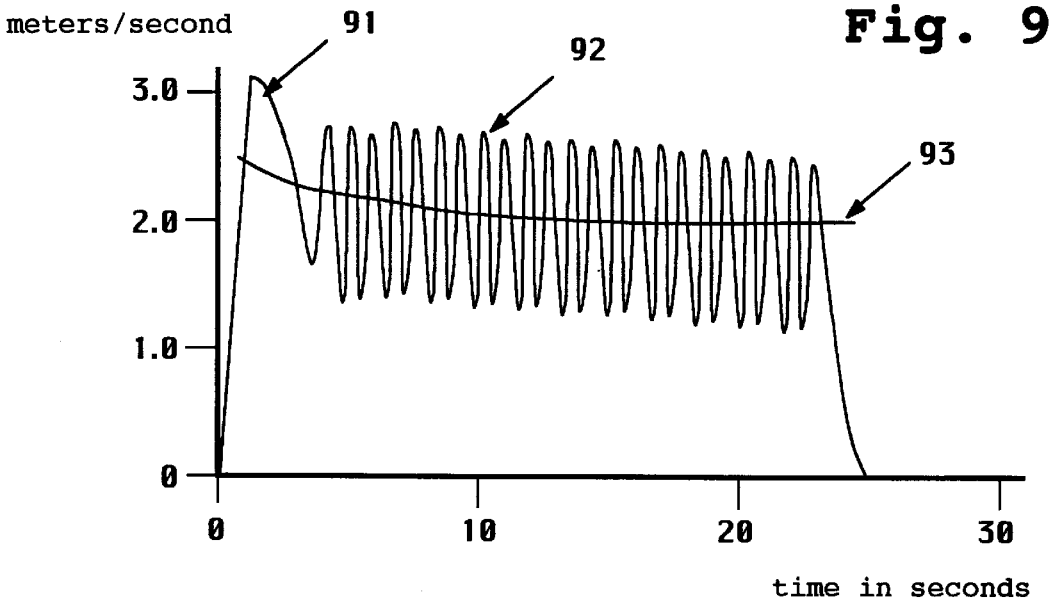
FIG. 9*a* and 9*b* are plots of a swimmer's speed over time.

Reference is now to made to a swimmer speed plot depicted in FIG. 9*a*. Speed is given in meters per second and time is specified in seconds. An onset peak 91 represents a burst of speed often observed at a start of a lap due to a leg push-off. Cycles of speed 92 represent a variation in speed due to varying amounts of propulsive force generated at different arm positions during a stroke. An average speed 93 represents a speed of a swimmer averaged out over a time interval longer than one stroke interval.

Figure 9B:
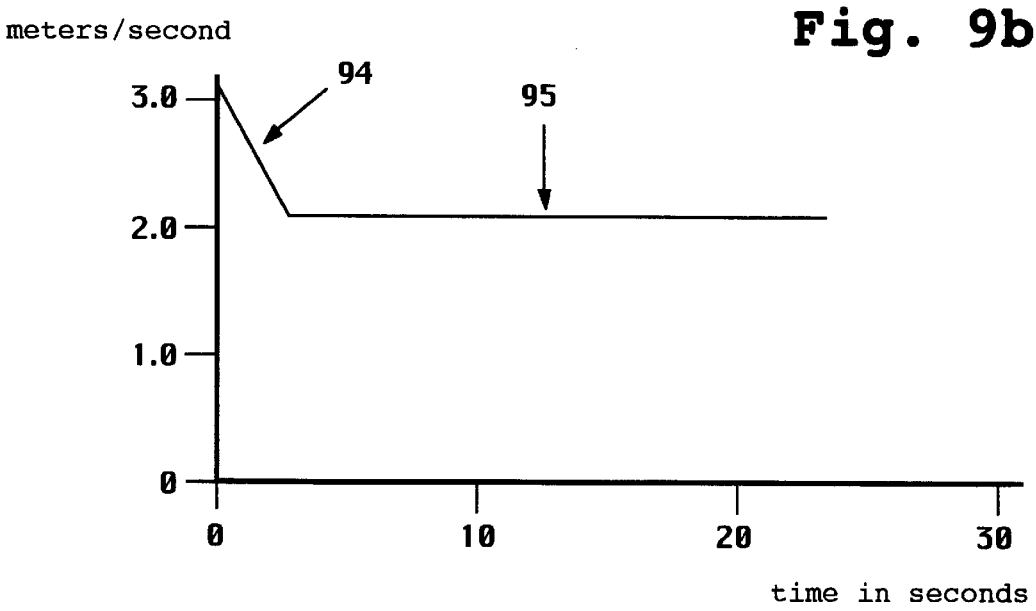

Reference is now to made to an assisted lap, positive force, speed plot depicted in FIG. 9*b*. Speed is given in meters per second and time is specified in seconds. An onset slope 94 represents a compensation for a burst of speed often observed at a start of a lap due to a leg push-off. An average assist speed 95 represents an average speed at which a swimmer is paced during an assisted lap.

DESCRIPTION OF THE OPERATION OF THE INVENTION

The following review of the general operation of the present invention is merely for illustrative purposes, and should in no way be considered either the sole or limiting view of the breadth and range of possible operational characteristics.

Preparations for the operation of the present invention consist of positioning the base 8 of the device adjacent to the edge of a pool 3 deck 10 as shown in FIG. 1, instructing the swimmer 1 to strap the harness assembly 4 around his waist and to enter the water 2. The default protocols for purposes of this illustration consist of a training resistance outgoing lap, and an assisted return lap. Operation begins with a message on the LCD 64 requesting the operator to select pool size, to set a resistance force, and then an assist speed. In addition, the operator may set a calibration factor by entering a scale factor or by entering a lap time or swimming speed, from a previously stop-watch timed lap. Such a correction time is used in calculating a ratio with the set speed and the controller utilizes that ratio to update a speed calibration parameter. Also, the operator may enter a pushoff boost parameter which the controller utilizes for a brief speed increase at the start of the assisted lap to compensate for the wall push-off with the legs. The operator selects these various parameters by pushing the respective buttons on the keypad 65 increasing or decreasing the parameters as desired. The operator then indicates to the swimmer that the lap may begin. When the swimmer is ready, he swims out in the resistance mode which is the default state of the mode relay 84. The operator does not press the run button 89 thereby leaving it in the normally open state which prevents the transistor 86 from actuating the mode relay 84 and therefore the contact set 77 remains in the normally closed state. The relay control transistor 86 has the base resistor 87 coupled to it's emitter for turn-off stability and the emitter bypass capacitor 88 suppresses contact bounce of the run switch 89. The braking relay 80 contacts 81 short the motor 29 terminals whenever power is removed from the device and so results in the braking of the motor 29.

As the swimmer begins swimming a resisted, negative force, outgoing lap, the cable 5 takes up tension, the float 6 assists in maintaining the cable above the swimmer's legs and the cable jacket 31 exits the drive train. The cable jacket 31 travels down from around the sheave 11, rotating the sheave about the sheave shaft 12 on the sheave bearings 34, moves away from the drum 20, passes through the opening between the sheave 11 and the idler roller 13 traveling over the pressure roller 19 and off of the cable drum 20 causing the drum 20 to rotate. When the end of the cable jacket 31 passes the idler roller 13, the idler roller shaft 14 disengages the limit switch 40 due to a positive force from the tension spring 39 and permits the limit switch 40 contacts to return to the normally closed position. The pressure roller 19 rotates on bearings 35 mounted on shaft 36 which is mounted in arm 17. The arm pivots on the sheave shaft 12 running through holes 37 and is forced towards the drum 20 by the pressure roller tension springs 18. As the cable 5 is unwound from the drum 20, the bailer sheave 11 travels follows the lateral motion of the cable 5 on the drum 20. The rotating drum 20 engages the drum shaft 21 which rotates in the drum bearings 22 mounted in the drive train frame 30 and subsequently rotates the timing gear 23. The timing gear in turn engages the timing belt 24 which passes under the belt idler 25 and engages the timing pinion 26 which couples rotational power to the motor 29. The optical sensor disk 27 rotates with the pinion 26 and causes a speed signal 42 to be output by the speed sensor 41.

The motor 29 subsequently generates a voltage which in turn causes a current to flow from the battery ground 83 through the power FET 70 into the negative terminal of the motor 29 and from the positive terminal of the motor 29 through the current sensor 67, through the normally closed contacts of contact set 78 to the battery ground 83. Flyback diodes 76, 79, and 85 serve to return reverse inductive currents and thereby prevent excessive buildups of reverse inductive voltages when currents through their respective inductors are interrupted. Suppression resistor and capacitor series pairs 71, 72 and 74,75 reduce unwanted RF energy generation. The current through the power FET 70 is regulated by the PWM signal 55. The current sensor 67 signal represents the motor 29 armature current which is directly proportional to the torque of the motor 29. Therefore, the current signal may be considered an equivalent to a force signal for purposes of discussion. The control of the motor is therefore characterized as a current control method. The PWM signal 55 is proportional to a function of the user selected control parameter of resistance force, which is applied to the non-inverting input of the force difference amplifier 49 and the force signal from the output of the second force filter 46, which is applied to the inverting input of the force difference amplifier 49, the output of which controls the degree of modulation generated by the PWM controller 50 in the manner of a force negative feedback loop. The force level set in the controller 90 microcomputer 60 is output to the DAC 61 which converts the digital signal to an analog signal voltage at the DAC output 52 which is directed through the multiplexer 48 to the non-inverting input of the difference amplifier 49. The multiplexer 48 selection path is controlled by digital control signal 53 from the microcomputer 60. The permanent magnet skewed armature pole type electric motor results in a smooth application of forces to the cable due to the lack of cogging at low speeds that can occur with straight pole type motors. This skewed armature type of motor can be supplied readily by most manufactures of permanent magnet electric motors. Note that for a speed assessment plot lap, the force setting is set to a low force which is just sufficient to maintain the cable tension necessary to ensure accurate swimmer speed measurements. FIG. 9*a* depicts a swimmer's speed plot over the duration of a lap. Speed is given in meters per second and time is specified in seconds. An onset peak 91 represents a burst of speed often observed at a start of a lap due to a leg push-off. This is utilized by a coach to correct for improper push-off. Cycles of speed 92 represent a variation in speed due to varying amounts of propulsive force generated at different arm positions during a stroke. These are utilized by a coach to correct for an imbalance in the power produced by each arm, breathing effects, and the like. An average speed 93 represents a speed of a swimmer averaged out over a time interval longer than one stroke interval. This is utilized to characterize the consistency of a swimmers speed during a lap.

When the swimmer 1 reaches the end of the resisted lap out, turns around, and makes ready, he signals the operator. As described above at the start of the lap out, the limit switch rod 14 disengages the limit switch 40 returning the contacts to the normally closed position which in turn completes one leg of the circuit of the mode relay 84. After the operator finishes setting the parameters, the microcomputer 60 outputs a logical high on the RE 54 signal line to enable the mode relay transistor 86. To initiate the assisted return lap in, the operator presses the run button 89 to complete the current path to the mode relay 84 which then closes the normally open contacts of contact set 77 to connect the positive terminal of the motor 29 to the battery positive 82. The above described mechanical operation of the outward lap is now reversed wherein the motor 29 provides a torque which rotates the drum 20 in a direction opposite to that of the outward lap and thereby winds the cable around it, applying force to the cable 5. The cable 5 in turn applies this force to the swimmer 1 which results in a reduction in the force required of the swimmer's 1 own propulsion. As the cable 5 winds in onto the drum 20, the pressure roller 19 works to maintain the cable 5 in an even wind while the bailer sheave 11 travels in a lateral motion due to the tangential angle of the cable 5 as it winds on the drum 20. This bailing action results in an even wind of cable upon the drum 20. At anytime, the operator may release the run button 89 to immediately shut off the motor 29 by removing the current from the coil of the mode relay 84. When the cable is wound in completely, the cable jacket 31 passes under the idler roller 13 forcing the idler roller shaft 14 to overcome the force of tension spring 39 and to engage the limit switch 40 whose contacts are forced into the normally open position thereby interrupting the current flow through the coil of mode relay 84.

During the return assisted lap, wherein a positive or towing force is applied to the swimmer, control of the motor 29 speed and therefore the cable and swimmer's speed is accomplished by means of a speed feedback loop. The speed parameter which is set in the microcomputer 60 and is output to the DAC 61 for conversion to an analog signal can be optionally programmed to begin at a faster pace and then ramp down to the set pace or speed. This type of boosted speed is required in training protocols wherein the swimmer 1 starts with a pushoff from the pool 3 wall which increases his speed momentarily. The device must therefore compensate by matching this increase at the start of the return lap. FIG. 9*b* depicts a plot of an onset slope 94 compensation for leg push-off. The controller then paces the swimmer at an average assist speed 95 as shown in FIG. 9*b*. A simple percentage scale factor may be used for the initial boost speed, and a simple straight line ramp or onset slope 94 over a second or two ending in the target pace speed can approximate the boost. The specification of the boost parameter may be expressed simply as a ratio relative to an average pace speed set for a swimmer. The programming of such an algorithm is quite straightforward for those skilled in the art.

The motor 29 current through the power FET 70 is regulated by the PWM signal 55. The PWM signal 55 is proportional to a function of the user selected control parameter of speed and the speed signal output 45 of the speed low pass filter 44. The motor 29 speed is converted to a digital pulse signal output 42 by the optical encoder sensor 41 which is converted by the frequency-to-voltage converter 43 to an analog signal. The output of the converter 43 is coupled to the input of the speed signal lowpass filter 44 and to the B input of the A2D converter 62 for monitoring by the microcomputer 60. The output 45 of the speed signal lowpass filter 44 is coupled to the inverting input of the speed differencing amplifier 47. The speed parameter set in the microcomputer 60 is output to the DAC 61 which converts the digital signal to an analog signal voltage at the DAC output 52 which is coupled to the non-inverting input of the speed difference amplifier 47. The output of the speed differencing amplifier 47 is directed through the multiplexer 48 from the A input to the non-inverting input of the difference amplifier 49. The multiplexer 48 selection path is controlled by digital control signal 53 from the microcomputer 60. The speed difference signal at the output of the speed differencing amplifier 47 therefore represents the difference between the desired speed and the actual speed. The gain of the speed differencing amplifier 47 is a scale factor that converts the speed difference signal into an optimal force signal that is employed as a reference force signal for force difference amplifier 49. As described above, the PWM signal 55 is proportional to the reference force signal applied to the non-inverting input of the force difference amplifier 49 and the force signal from the output of the second force filter 46, which is applied to the inverting input of the force difference amplifier 49, the output of which controls the degree of modulation generated by the PWM controller 50 in the manner of a force negative feedback loop. Whenever the force applied by the motor 29 exceeds a preset maximum value during the inbound lap, the force is limited by a threshold comparator in the PWM controller 50. The force signal lowpass filter 68 output 56 is coupled to the inverting threshold input of the PWM controller 50 and a reference signal set by the variable resistor 51 is coupled to the non-inverting input of the PWM controller 50. Whenever the force signal 56 exceeds the reference voltage at resistor 51, the PWM controller 50 is restricted to that force and cannot exceed it. The device must also compensate for mechanical losses in the drive train which is accomplished with an analog offset from resistor divider 59 for summation into the force difference amplifier 49. Other compensation methods might include modifying the force parameters which are set in the microcomputer 60 to include offsets for such compensation.

The characteristics of the speed low pass filter 44 are typically those of a lowpass filter which filters out the variations in speed within the stroke, or stroke ripple, to provide a smoothed or averaged speed feedback signal. The short-term averaging interval of the speed filter should range from one half of a stroke in duration to twice a stroke duration. The characteristics of the force low pass filter 46 are typically those of a lowpass filter which filters out the variations in speed that are much faster than the stroke ripple frequency, such as those attributable to mechanical drive train sources, while passing variations at or below the stroke ripple frequency. The short-term averaging interval of the force filter should range from less than one half of a stroke in duration to approximately one twentieth of a stroke duration. The assistance force applied to the swimmer assists him in overcoming the force of drag thereby increasing his speed over the maximum he might attain otherwise. The speed control paces the swimmer at an averaged assist velocity which aids in the training of the swimmer's stroke rate at competition levels. This speed control system can be considered as a speed feedback system controlling a force feedback system such that a desired speed results in the average force necessary to maintain that speed.

The digital pulse signal 42 from the optical speed sensor is coupled to the microcomputer 60 where it is counted in a pulse accumulator. The count value is directly proportional to the number of rotations of the drive train and therefore to the revolutions of the drum and thus to the quantity of cable 5 wound upon the drum. This provides the microcomputer 60 with information on the location of the swimmer 1 during the lap. The microcomputer 60 additionally has the input RM 58, which signals the state of the mode relay 84, for use in monitoring the status of the device. The force signal 56 from lowpass filter 68 is coupled to the A input of the A2D converter 62 and the speed output signal 57 of the F2V converter 43 is coupled to the B input of the A2D converter 62. This provides the microcomputer 60 with immediate speed and force values for the cable 5. These values may be used in the calculations and control of the motor 29 or may be sent to the serial interface 66 for transmission to a personal computer for storage and plotting. Such a computer might be an industry standard battery powered notebook type IBM PC clone capable of VGA type graphics, a mouse or similar pointing device, and possessing a microprocessor capability of at least an INTEL 486/16 mHz type. A program running on such a computer should permit plotting and measuring of speed and force data as well as a data file storage and retrieval capability.

APPLICATIONS OF THE INVENTION

In the present invention, apparatus and methods are revealed which provide for the measurement and application of positive or negative forces to a swimmer in a pool or aquatic environment while controlling complex relationships of the swimmer's speed, force, power, distance traveled, and elapsed time. The positive force applying means of the present invention provides for the pacing of a swimmer and the off-loading of the propulsive force required of the swimmer at or above competition speeds. This pacing and off-loading encourages improvements in the swimmer's stroke mechanics at elevated speeds for extended periods of time while minimizing detrimental effects on the swimmer's stroke dynamics. The negative force applying means of the present invention provides for the resistive overloading of a swimmer which is believed to increase muscle strength as well as to train the anaerobic energy system. The data transfer and plotting means of the present invention provide for analysis of stroke patterns and rates thereby permitting a coach to provide informed critique and instruction to a swimmer regarding stroke mechanics.

Although one possible embodiment has been described to illustrate the teachings and disclosures of the present invention it is not limited to the specific foregoing illustrative embodiment or applications and that various and several modifications in design, arrangement, and use may be made within the scope and spirit of the invention as expressed in the following claims:

What is claimed is:

1. A swim instruction apparatus comprising:

a cable having a proximal end and a distal end;

a harness for coupling the distal end of the cable to a swimmer in a body of water;

a motorized drum coupled to the proximal end of the cable for winding and unwinding the cable for applying forces to the cable;

a speed sensor coupled to the cable for generating an output signal proportional to a speed of the cable;

a first signal filter coupled to the speed sensor output for generating an output signal proportional to a short-term average speed of the cable and characterized by an averaging interval of at least one half of a swimming stroke interval in duration;

a speed controller coupled to the output of the filter, the speed controller generating a speed control output signal inversely proportional to the output signal of the first filter;

a force sensor coupled to the cable for generating an output signal responsive to a cable tension force;

a second signal filter coupled to the force sensor output for generating an output signal proportional to a short-term average force on the cable and characterized by an averaging interval of no more than approximately one half, but at least approximately one twentieth, of a swimming stroke interval in duration and no less than approximately a maximum cycle period of force variation attributable to characteristics of the motorized drum; and a force controller coupled to the speed controller output, the second signal filter output and to the motorized drum whereby the force controller controls the forces applied to the swimmer through the cable as the swimmer swims in the body of water in proportion to the output signal of the speed controller and inversely proportional to the output signal of the second signal filter, the applied forces being responsive to both interstroke variations in speed and intrastroke variations in force while being unresponsive to both variations in force attributable to characteristics of the motorized drum and variations in intrastroke speed.

2. The apparatus of claim 1, wherein the motorized drum includes an electric motor coupled to the force controller and to the force sensor, the force sensor including a motor armature current sensor for generating an output signal proportional to the cable tension force.

3. The apparatus of claim 1, wherein the speed controller includes an adjustable signal source for generating an output signal representing a value of a speed parameter selected from a range of values, the output signal from the speed controller being derived from both the output signal of the first filter and the output signal of the speed parameter signal source.

4. The apparatus of claim 1, wherein the speed controller includes a signal source for generating an output signal representing a varying speed parameter, the output signal from the signal source smoothly varying according to approximately a straight slope from an initial speed value to a final speed value over a pushoff time interval of approximately one to two seconds commencing at the start of a lap and ending shortly after the swimmer's initiation of stroking, the initial speed value being a percentage greater than one hundred percent of a final speed value whereby the speed controller generates a speed control output signal inversely proportional to the output signal of the filter and proportional to the output of the varying speed parameter signal source to control the forces applied to the swimmer through the cable as the swimmer swims laps in the body of water.

5. A swim instruction apparatus comprising:

a cable having a proximal end and a distal end;

a harness for coupling the distal end of the cable to a swimmer in a body of water;

a drum coupled to the proximal end of the cable for winding and unwinding the cable;

a multipole electric motor of a skewed armature type of construction coupled to the drum for applying forces to the cable;

a force sensor coupled to the cable for generating an output signal responsive to a cable tension force;

a signal filter coupled to the force sensor output for generating an output signal proportional to a short-term average force on the cable and characterized by an averaging interval of no more than approximately one half of a swimming stroke interval in duration; and a force controller coupled to the signal filter output and to the electric motor whereby the force controller controls the forces applied to the swimmer through the cable as the swimmer swims in the body of water, the applied forces being inversely proportional to the output signal of the signal filter and exhibiting minimal variations attributable to the armature construction of the electric motor.

6. The apparatus of claim 5, wherein the force sensor includes a motor armature current sensor coupled to the motor for generating an output signal proportional to the cable tension force.

7. The apparatus of claim 5, wherein the force controller includes an adjustable signal source for generating an output signal representing a value of a force parameter selected from a range of values, the output signal from the force controller being derived from both the output signal of the filter and the output signal of the force parameter signal source.

8. A swim instruction apparatus comprising:

a cable having a proximal end and a distal end;

a harness for coupling the distal end of the cable to a swimmer in a body of water;

a drum coupled to the proximal end of the cable for winding and unwinding the cable;

a multipole electric motor of a skewed armature type of construction coupled to the drum for applying forces to the cable;

a speed sensor coupled to the cable for generating an output signal proportional to a speed of the cable;

a signal filter coupled to the speed sensor output for generating an output signal proportional to a short-term average speed of the cable and characterized by an averaging interval of at least approximately one half of a swimming stroke interval in duration;

a speed controller coupled to the output of the filter and to the electric motor whereby the speed controller generates a speed control output signal inversely proportional to the output signal of the filter to control the forces applied to the swimmer through the cable as the swimmer swims in the body of water, the applied forces being responsive to the interstroke variations in speed and only exhibiting minimal variations attributable to the armature construction of the electric motor.

9. The apparatus of claim 8, wherein the speed controller includes an adjustable signal source for generating an output signal representing a value of a speed parameter selected from a range of values, the output signal from the speed controller being derived from both the output signal of the filter and the output signal of the speed parameter signal source.

10. The apparatus of claim 8, wherein the speed controller includes a signal source for generating an output signal representing a varying speed parameter, the output signal from the signal source smoothly varying according to approximately a straight slope from an initial speed value to a final speed value over a pushoff time interval of approximately one to two seconds commencing at the start of a lap and ending shortly after the swimmer's initiation of stroking, the initial speed value being a percentage greater than one hundred percent of a final speed value whereby the speed controller generates a speed control output signal inversely proportional to the output signal of the filter and proportional to the output of the varying speed parameter signal source to control the forces applied to the swimmer through the cable as the swimmer swims laps in the body of water.

11. A swim instruction apparatus comprising:

a cable having a proximal end and a distal end;

a harness for coupling the distal end of the cable to a swimmer in a body of water;

a motorized drum coupled to the proximal end of the cable for winding and unwinding the cable for applying forces to the cable;

a speed sensor coupled to the cable for generating an output signal proportional to a speed of the cable;

a signal filter coupled to the speed sensor output for generating an output signal proportional to a short-term average speed of the cable and characterized by an averaging interval of at least approximately one half of a swimming stroke interval in duration;

a signal source for generating an output signal representing a varying speed parameter, the output signal from the signal source smoothly varying according to approximately a straight slope from an initial speed value to a final speed value over a pushoff time interval of approximately one to two seconds commencing at the start of a lap and ending shortly after the swimmer's initiation of stroking, the initial speed value being a percentage greater than one hundred percent of a final speed value; and a speed controller coupled to the output of the filter, to the output of the signal source and to the motorized drum whereby the speed controller generates a speed control output signal inversely proportional to the output signal of the filter and proportional to the output of the varying speed parameter signal source to control the forces applied to the swimmer through the cable as the swimmer swims laps in the body of water.

12. The apparatus of claim 11, wherein the motorized drum includes an electric motor coupled to the force controller and to the force sensor, the force sensor including a motor armature current sensor for generating an output signal proportional to the cable tension force.

13. The apparatus of claim 11, wherein the varying speed parameter signal source includes an adjustable signal source for generating an output signal representing a value of the final speed parameter selected from a range of values, the output signal from the varying speed parameter signal source being derived from the output signal of the adjustable signal source.

14. The apparatus of claim 11, wherein the motorized drum includes a multipole electric motor of a skewed armature type of construction coupled to the drum.

* * * * *